United States Patent [19]

Salisbury

[11] Patent Number: 4,651,985

[45] Date of Patent: Mar. 24, 1987

[54] EXERCISE DEVICE

[76] Inventor: William F. Salisbury, 264 E. 700 South, Springville, Utah 84663

[21] Appl. No.: 698,342

[22] Filed: Feb. 4, 1985

[51] Int. Cl.[4] ..... A63B 21/00; A63B 21/02

[52] U.S. Cl. ..... 272/68; 272/116; 272/137

[58] Field of Search ..... 272/67, 68, 116, 117, 272/126, 135, 137, 141, 142, 901

[56] References Cited

U.S. PATENT DOCUMENTS

| | | | |
|---|---|---|---|
| 2,475,656 | 7/1949 | Bidak | 272/117 X |
| 3,396,967 | 8/1968 | Brown | 272/67 |
| 3,947,025 | 3/1976 | Hobby, Jr. | 272/901 X |
| 3,964,340 | 6/1976 | Antonio et al. | 272/68 X |
| 4,218,057 | 8/1980 | Wilson | 272/117 |
| 4,249,729 | 2/1981 | Gabrielidis | 272/135 X |
| 4,489,937 | 12/1984 | Kong | 272/137 |

FOREIGN PATENT DOCUMENTS

| | | | |
|---|---|---|---|
| 124746 | 10/1901 | Fed. Rep. of Germany | 272/135 |
| 448177 | 7/1927 | Fed. Rep. of Germany | 272/142 |
| 16256 | 10/1912 | France | 272/68 |

*Primary Examiner*—Robert A. Hafer
*Assistant Examiner*—Kathleen J. D'Arrigo

[57] ABSTRACT

New exercising device, intended particularly for exercising the muscles of the hand, wrist and forearm, comprising an exercising means made up of a tightly wound coil spring and handle means attached to both ends of the exercising means to permit grasping of the device by the operator, said handle means also comprising a tightly wound coil spring of smaller size so as to fit within the ends of the exercising means.

8 Claims, 5 Drawing Figures

EXERCISE DEVICE

This invention relates to a new type of exercising device, and more particularly to a hand held coil spring exercising device with special handles which permit improved exercising of the muscles of the hand, wrist and forearm.

Specifically, the invention provides a new and improved exercising device, intended particularly for exercising of the muscles of the hand, wrist and forearm, comprising in combination an exercising means made up of a tightly wound coil spring having a first and second end, handle means associated with each of said ends to permit grasping of the device by the hands of the operator, said handle means also comprising a tightly wound coil spring of smaller size so as to fit within the ends of the said exercising means, said handle means preferably being disposed in screw threaded engagement within the ends of the exercising means so that one may vary the length of the handle means.

PRIOR ART

Exercise which strengthens the muscles of the hand, the wrist and the forearm are particularly valuable to sportsman engaged in sports where the muscles are continually brought into play in holding and wielding bats, rackets, golf clubs and the like, and also for athletes such as oarsmen where strength of these muscles is important. Further in such exercise it is important to be able to gradually increase the work done during exercising so as to continue to strengthen and increase the power of the desired muscles.

Many devices have been proposed for use in accomplishing such exercises, but they have not met all the special needs of the sportsman. Some are based on the use of coiled springs, but these generally are limited to the exercise of just certain specific muscles, and can not be varied so as to continually increase the power of the muscles involved. Some are based on a twisting or a bending action, but are not capable of being used for both actions. In addition, many devices are elaborately constructed and expensive, or are difficult to operate and carry around. Others are set at one tension and cannot be varied to increase or decrease the tension as needed by that respective operator.

It is an object of the invention, therefore, to provide a new and improved exercising device. It is a further object to provide a new spring-type exercising device that can be used to strengthen a great variety of different muscles. It is a further object to provide an exercising device that can be adjusted to give different tensions so as to increase or decrease the force needed to do the exercise. It is a further object to provide a new hand held spring-type exercise device that can be easily and economically manufactured and is durable in use. It is a further object to provide a new exercise device that can be easily carried and stored. These and other objects of the invention will be apparent from the following detailed description thereof.

SUMMARY OF THE INVENTION

It has now been discovered that these and other objects may be accomplished by the new exercising device of the present invention comprising in combination an exercising means made up of a tightly wound coil spring having a first and second end, handle means associated with each of said ends to permit grasping of the device by the hands of the operator, said handle means also comprising a tightly wound coil spring of smaller size so as to fit within the open ends of the said exercising means, said handle means preferably being disposed in screw threaded engagement within the ends of the exercising means so that one may vary the length of the handle and thus the tension needed to operate the device.

The exercising device of the present invention is designed specifically for those muscles of the fingers, thumbs, hands, wrist, rotators-pronators-extensors of the forearms, bicep-tricep of the upper arms, pectoralis major and minor of the chest, deltoid, latisimus dorsi, infra and super spinatus of the back and upper abdominal muscles.

The unique feature of the new exercising device in building up, toning and strengthening the aforementioned muscles over other devices is that it can be bent and twisted at the same time, thus providing exercises where you have rotation of wrist and forearm muscles.

Another unique feature of the new exercising device of the present invention is the ability of the operator to adjust the tension and thereby vary the force needed in the exercising. This can be easily accomplished by increasing or decreasing the length of the handle means by screwing the handles into or out further from the exercising mean coil springs. Thus, if one wanted to increase the tension in the exercise, this could be done by decreasing the length of the coil spring handles, and if one wanted to decrease the tension this could be accomplished by lengthening the handles.

Another unique feature of the new exercising devices of the present invention is that the handles being of spring construction and hollow inside can be filled with various weights to increase or decrease the weight of the handles and the exercise device as a whole. This provides the user added dimension of a floating or movable weight inside the handle providing the user another variable control on the force needed to complete the exercise.

A further advantage of the new exercise devices of the present invention comprises a protective or safety strip over the handles of the exercising device. These have a two fold purpose: 1. So that the exerciser cannot slip out of the user's hand or hands. 2. Safety or protective strip fitting over the hand, finger and knuckle areas provide another exercise for hand and finger flexor muscles. Hands with strips over them are extended or stretched out straight by the user. The resistance is provided by the said safety hand strips.

Further advantage of the new exercising devices is the fact that they permit a multitude of exercises by which numerous muscles of the body can be trained, and the exerciser can be operated in various positions, such as sitting, standing, lying down, bending, etc. Further, the device is simple and robust construction and can be used in the home, office, school or for professional use in studios and gymnasiums. The devise is very small compared to many known devices and can be easily carried in brief cases, suitcases and the like.

Another very useful modification of the exerciser of the present invention comprises the feature of having a hook or device in the center of the exercising means to accommodate a nylon cord or string of extended length with a removable and adjustable weight at the end of the string. The exercising device is then held at arms length in front of the body, arms extended and with a twisting and rotation of hands or wrist either in a forward action together or in a reverse action together, the weight at the end of the cord or string, which can be varied as desired, is lifted by rotation of the wrists and hands and the rope winds around the exerciser means to which it is attached.

While the springs in the exerciser means and the handles are tightly bound and difficult to be extended by pulling, yet they slowly yield to strong pulling and such action provides an additional exercise so as to permit a pulling, twisting and bending exercise at the same time.

BRIEF DESCRIPTION OF THE DRAWING

FIG. 1 is a perspective representation of the new exercising device of the present invention.

FIG. 2 is a sectional view cut through the center of the exercising device shown in FIG. 1, showing how the handles fit within the ends of the exerciser means and can be screwed into or out of said ends.

FIG. 3 is a sectional view of the handle showing how free moving weights can be contained within the said handle to vary the exercising as noted above.

FIG. 4 is a perspective view of a handle of the exercising device showing the presence of the safety strip over the handle.

FIG. 5 is a perspective view of the new exercising device showing the presence of a cord attached to the exerciser means and having removable weights attached to the end of the cord to assist in the variable exercise as noted above.

The exercising device shown in FIG. 1 is made up of a tightly wound coil spring exerciser means 11 having open ends, and handle means 12 also comprising tightly wound coil springs of small size which fit inside the open ends of the exerciser means 11. The handle means are screw threaded into the exerciser means as shown in FIG. 2. As shown in FIG. 2, the handles can be lengthened or shortened as desired by merely screwing the handles in or out of the end of the exerciser means.

FIG. 3 illustrates the exercising device wherein the ends of the handle 12 are closed at 19 and contain added weights 14. The closed handle ends will retain the added weights, but if desired a flexible tube, such as one made out of flexible plastic, may be inserted into the hollow handle to insure the retention of the weights in the handle.

FIG. 4 illustrates the presence of a safety strip or handle 15 on the handle means to prevent the user's hands from slipping off the handle. The strips may be attached to the handle by means of a bolt, screw, adhesive or the like.

FIG. 5 illustrates the modification of the new exercising device wherein a cord or string, preferably of nylon, is attached to the exercising means, preferably at the center thereof, with a removable and variable weight at the end of the cord. The cord 17 can be tied around the exerciser means or attached thereto by means of a bolt or screw 16. The weight 18 at the end of the cord can be removed and varied by adding or taking away weights, thus permitting another variable control on the tension and force needed in the use of the exerciser of the present invention.

DETAILED DESCRIPTION OF THE INVENTION

Figure 1:
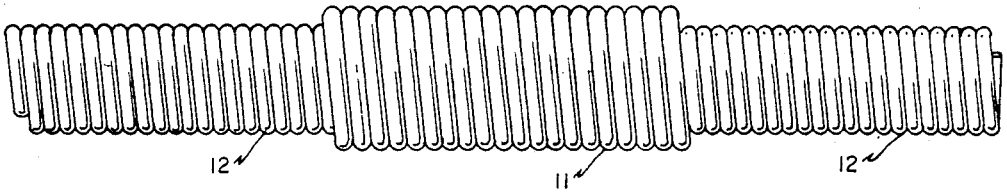
FIGS. 1 to 5 illustrate the various aspects and modifications of the present invention.
Figure 2:
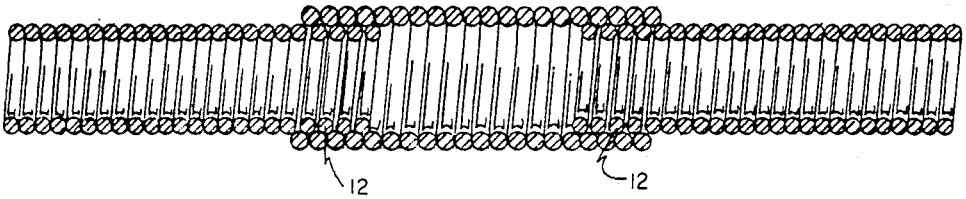
Figure 4:
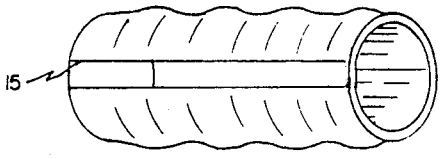
Figure 3:
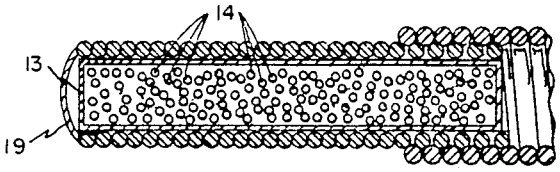
Figure 5:
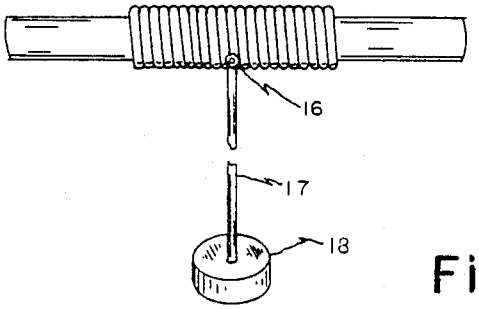

The exercising means described above comprises a tightly wound coil spring with open ends. It can be constructed in any desired manner as long as it meets the indicated purpose. Preferably it is made up of a coil spring of steel wire of varying diameter, such as 3/16 to 6/16, wound in a coil having a variable diameter, such as from 1¼ to 2 inches. The coil is tightly wound and considerable force is needed to bend or twist the coil, and while yielding to extension is very difficult to pull or extend. The coiled spring may be of any suitable length, but is preferably from 6 to 10 inches in length. The tension needed to use the exerciser and the intended purpose will help in dictating the size of the wire, diameter of coil, tightness of the wind, length of the exercising means. For appearances, the wound coil may be painted or coated with thin plastic coating, such as a vinyl plastic coating, if desired.

The handle means attached to each end of the exercising means are also tightly wound coil springs, preferably with open ends. These handle means can be constructed in any desired manner as long as they meet the indicated purpose. Preferably they are made up as the above-noted exerciser means of a coil spring of steel wire of varying diameter, such as 3/16 to 6/16, wound in a coil having a variable diameter smaller than that of the exerciser means so that the said handle means can fit into the open ends of the exerciser means. Such diameters preferably vary from about 1 inch to 1¾ inches. The coils are tightly wound and considerable force is needed to bend or twist the coil, and while yielding to extension are very difficult to pull or extend. The handle mean coils may be wound equal to, tighter or looser than the exerciser means, but superior results are obtained when the handle mean coils are more tightly wound than the exerciser means, thus permitting addition force to be used in bending or twisting the said handles. They are usually 4 to 8 inches.

The handle means may be fixedly attached to the exercising means or more preferably may be screw threaded into the open ends of the exercising means. This permits the special advantage of being able to vary the length of the handle means as needed and thus increase or decrease the tension needed in the use of the exerciser device.

The handle means are also hollow coils and can be used to hold various types of weights to give improved and modified utility to the exercising device. In this case, the end of the handle opposite to the one being screwed into the exercising means is closed, such as by tape or a metal closure, and the weights are placed in the closed end of the handle. More preferably a plastic flexible tube may be introduced into the center of each handle and the weights placed within the enclosed flexible tubes. The weights employed in this case may be BB shots or other metal weights which can be added in varying amounts as needed and are free flowing so that the movement of the weights will added in the exercise. The amount of the weights added of course will depend upon their intended use, but preferably may vary from about 8 oz to about 1 or 2 pounds.

The handle means may also possess a safety strip to prevent slipping of the user's hand from the said handle. These strips, which are preferably from about ½ to 1 inch in width, may be prepared from any strong flexible material, such as nylon, rubber or less flexible material, such as metal or the like. They may be of any desired length, but are preferably such as to extend from the end of the handle to the end being introduced into the exerciser means. The attachment of the strips to the handles may be accomplished by any suitable means, such as adhesives, screws, bolts, and the like. The arrangement should be such as to permit the user's hand to fit snuggly under the strip but also permit a firm grasp of the handle by the user.

As noted, the exercising device of the present invention can also be modified by attaching a cord or string, preferably of nylon of size preferably ⅛ to 3/16 inches, to the exercising means so that the cord can be wound around the said means by twisting or rotating the handles. Removable weights can be attached to the other end of the cord and the combination used as an added exercising device, particularly for the exercising of the flexor, bicep and tricept muscles. The weights may be of various sizes and shapes as desired or needed for that type of exercise.

The above-noted exercise devices can be utilized in a great variety of applications. The exercising device permits a great multitude of exercises by which numerous muscles of the human body can be trained. As noted above, the device is designed particularly for those muscles in the fingers, thumbs, hands, wrist, rotators-pronators-extensors of the forearms, bicep-tripce of the upper arms, pectoralis major and minor of the chest, deltoid, latisimus dorsi, and super spinatus of the back and upper abdominal muscles.

For general use, the exercise device is grasp by the handles by the user's hands and force is applied to bend, twist, etc. and the force is resisted by the coil springs of the exercising means and the handle means. The work thus created effects excellent training of the desired muscles. As the muscles become stronger, the tension can be increased as noted above by shortening the length of the handles or by the addition of the weights inside the hollow handles.

By modifying the device as noted above by attaching a cord to the exercising means and placing weights at the end of the cord, an additional exercise and strengthening of muscles can be obtained. After the correct amount of weights have been added at the bottom of the cord, the exercising device is held at arms length in front of the body, arms extended and with a twisting and rotation of hands or wrist either in a forward action together in a reverse action together, the weights at the end of the cord are lifted by such action and the cord winds around the exerciser means to which it is attached.

For safety reasons, the user should preferably utilize the safety strips attached to the handles. Such strips also provide another exercise for the hand and finger flexor muscles. Hands with strips over them are extended or stretched out straight by the user. The resistance and strengthening is provided by said safety hand strips.

A specific example of the new exercising device of the present invention is illustrated in the drawing. A typical example is prepared from coil metal spring of about 1 inch in diameter prepared from steel wire of about 3/16 inches in diameter, the exercising means coil having a length of about 6 inches, the handle means being prepared from the same type of steel wire but the coils being of smaller diameter so as to fit within the exercising center coil, said handle coils being about 6 inches in length.

I claim as my invention:

1. An exercising device comprising in combination an exercising means comprising a tightly wound coil spring having a first and second end, handles attached to each of said ends to permit grasping of the device by the hands of the operator, said handles consisting essentially of a tightly wound coil spring of smaller size than the coil spring of the exercising means so as to fit within the ends of the said exercising means and are disposed in screw threaded engagement within the ends of the exercising means so that the handles can be screwed in or out and thereby lengthen or shorten the said handles, the lengthening or shortening of said handles acting to decrease or increase the resistance of the exercising device.

2. An exercising device as in claim 1 wherein the handles are hollow and closed at the outer end and capable of holding various sized weights.

3. An exercising device as in claim 2 wherein the handles contain inside various sized weights which can move about at the motion of the exerciser.

4. An exercising device as in claim 1 wherein the wound coil springs of the handles are more tightly bound than the coil springs of the exercising means.

5. An exercising device as in claim 1 wherein the tightly wound coil spring of the exercising means is from 4 to 10 inches in length and prepared by winding of steel wire of 3/16 to 6/16 inches in diameter in a coil of diameter of 1¼ to 2 inches.

6. An exercising device as in claim 1 wherein the tightly wound coil springs of the handle means is from 4 to 10 inches in length and prepared by winding of steel wire of 3/16 to 6/16 in diameter in a coil of smaller diameter than the coil spring in the exercising means and capable of being in screw threaded relationship thereto.

7. An exercising device as in claim 1 wherein a safety strip is placed over both handles so as to prevent slipping of the users hand.

8. An exercising device comprising in combination an exercising means comprising a tightly wound coil spring having a first and second end, handle means attached to each of said ends to permit grasping of the device by the hands of the operator, said handle means also comprising a tightly wound coil spring of smaller size than the coil spring of the exercising means so as to fit within the ends of the said exercising means, and having a cord attached to the exercising means with a weight at the end of the cord, said attachment being such as to prevent the cord to be wound on the exercising means by the rotation of the handle means.

* * * * *